US009777572B2

(12) United States Patent
Morgan et al.

(10) Patent No.: US 9,777,572 B2
(45) Date of Patent: Oct. 3, 2017

(54) MULTI-PROBE RESERVOIR SAMPLING DEVICE

(71) Applicant: Baker Hughes Incorporated, Houston, TX (US)

(72) Inventors: Christopher John Morgan, Spring, TX (US); Hermanus J. Nieuwoudt, Tomball, TX (US); James T. Cernosek, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 235 days.

(21) Appl. No.: 14/543,511

(22) Filed: Nov. 17, 2014

(65) Prior Publication Data

US 2016/0138396 A1 May 19, 2016

(51) Int. Cl.
*E21B 49/10* (2006.01)

(52) U.S. Cl.
CPC ..... *E21B 49/10* (2013.01)

(58) Field of Classification Search
CPC ..... E21B 49/10
See application file for complete search history.

(56) References Cited

U.S. PATENT DOCUMENTS 5,138,877 A * 8/1992 Desbrandes ..... E21B 47/02 166/264
6,431,270 B1 8/2002 Angle
6,629,568 B2 10/2003 Post et al.
6,702,010 B2 3/2004 Yuratich et al.
7,036,362 B2 5/2006 Haddad et al.
7,303,011 B2 12/2007 Reid et al.
8,106,659 B2 1/2012 McGregor
8,464,791 B2 6/2013 Jacob
8,522,870 B2 9/2013 Fox et al.
8,579,037 B2 11/2013 Jacob
2007/0284099 A1 12/2007 DiFoggio
2008/0066536 A1 3/2008 Goodwin
(Continued)

FOREIGN PATENT DOCUMENTS

WO WO 2013081782 6/2013
WO WO 2014143052 A1 9/2014

OTHER PUBLICATIONS

PCT Search Report mailed Feb. 12, 2016—S.N. PCT/US2015/060800, Filed Nov. 16, 2015.

*Primary Examiner* — Brad Harcourt
(74) *Attorney, Agent, or Firm* — Bracewell LLP; Keith R. Derrington

(57) ABSTRACT

A tool insertable into a wellbore for sampling formation fluids includes a body, and sample probe assemblies that project radially outward from the body and into sampling contact with the wellbore wall. Packers are provided on the outer terminal ends of the sample probe assemblies and which are urged against the wellbore wall. Actuator driven linkage assemblies selectively deploy and retract the packers from and back into the body. The sample probe assemblies are disposed at substantially the same axial location on the body, and are angularly spaced about an axis of the body. Each sample probe assembly is independently actuated, so that a discrete azimuthal portion can be sampled, and each has a dedicated sample container for storing sampled formation fluid.

9 Claims, 5 Drawing Sheets

(56) References Cited

U.S. PATENT DOCUMENTS

| | | | | |
|---|---|---|---|---|
| 2008/0115574 | A1* | 5/2008 | Meek | E21B 17/10 73/152.03 |
| 2011/0067860 | A1 | 3/2011 | Corre | |
| 2011/0198078 | A1 | 8/2011 | Harrigan et al. | |
| 2011/0284227 | A1* | 11/2011 | Ayan | E21B 43/16 166/307 |
| 2012/0048542 | A1 | 3/2012 | Jacob | |
| 2013/0255367 | A1 | 10/2013 | Dussan et al. | |
| 2016/0053612 | A1* | 2/2016 | Proett | E21B 49/10 166/264 |

* cited by examiner

MULTI-PROBE RESERVOIR SAMPLING DEVICE

BACKGROUND OF THE INVENTION

1. Field of Invention

The present disclosure relates to a device and method for sample a reservoir with multiple sampling probes that are independently operated from one another.

2. Description of Prior Art

The sampling of fluids contained in subsurface earth formations provides a method of testing formation zones of possible interest. The sampled formation fluids are usually later analyzed in a laboratory environment, and sometimes provide a point test of the possible productivity of subsurface earth formations. Analyzing the fluid sometimes yields pressure and permeability information of the formation, as well as fluid compressibility, density and relative viscosity of the formation fluid.

Sampling connate fluid generally involves disposing a sonde into a wellbore, and communicating a sample port on the sonde with the formation surrounding the wellbore. When the sample port is proximate to an area of interest in the formation, an urging means on the sonde extends against the inner surface of the wellbore thereby engaging the sample port into the formation. The engagement of the sample port usually pierces the outer diameter of the wellbore and enables fluid communication between the connate fluid in the formation and the sample port. After urging the sample port into the formation, the connate fluid is typically siphoned into the sonde with a pumping means disposed therein. The sampled fluid is sometimes analyzed in the sonde, or on surface after being transported out of the wellbore.

SUMMARY OF THE INVENTION

Described herein is an example of a downhole tool for sampling formation fluid in a wellbore that includes a body and sample probe assemblies. In this example the sample probe assemblies are made up of linkage assemblies, pad assemblies that selectively project radially outward from the body on the ends of the linkage assemblies and into sampling engagement with a wall of the wellbore at substantially the same measured depth in the wellbore, and actuators in the body coupled with each one of the linkage assemblies and that are each selectively operated independently from the other actuators. Valves can be provided that are selectively opened and closed and that provide selective fluid sampling. The tool can optionally include sample tanks, wherein each one of the sample tanks are in fluid communication with a one of the sampling pads, so that formation fluid obtained by each of the sampling pads is stored in a one of the sample tanks. A conduit between each one of the pad assemblies and each one of the sample tanks can be included with this example. The pad assemblies can be made of a packer having an outer radial surface that contacts the wellbore wall, and a port in a mid-portion of the outer radial surface that is in fluid communication with the formation fluid in a formation intersected by the wellbore. Pressure sensors may be included that are in communication with each of the sample probe assemblies, so that pressure of a formation intersected by the wellbore can be sensed along discrete locations along the circumference of the wellbore and at the same depth in the wellbore. In an example the linkage assemblies each have an arm with an end hingedly coupled with the body, a hydraulically actuated piston coupled with the arm, and wherein the actuator is a hydraulic source in selective pressure communication with an end of the piston, so that when the hydraulic source provides pressurized fluid to an end of the piston, the arm is selectively moved radially with respect to the body to move the pad assembly with respect to the wellbore wall. In another alternative, the linkage assemblies each have an arm, and wherein the actuator is a screw having an end coupled to a motor, and having a portion that threadingly engages the arm, so that when the screw is rotated by the motor, the arm is moved radially with respect to the body. In another example, the linkage assemblies each have a series of arms pivotingly linked in series together, and wherein a one of the pad assemblies is mounted on a middle one of the arms, so that when a force is applied to an end of the series of arms, the one of the pad assemblies is urged radially with respect to the body. A controller may be included with the tool that is in communication with the actuators, so that each of the actuators is operated independently with respect to the other actuators. In an example, the linkage assemblies travel along an arcuate path between a stowed position adjacent the body and an engaged position in contact with the wellbore wall.

Also disclosed herein is an example of a downhole tool for sampling formation fluid in a wellbore and that includes a body, articulated linkage assemblies, each of which having an end coupled with the body, and each of which selectively and independent from one another move between a stowed position to a deployed position. The tool also includes pad assemblies on ends of the linkage assemblies that are distal from the ends that are coupled to the body and that are at substantially the same depth in the wellbore when the linkage assemblies are in the deployed position, and ports on the pad assemblies that are in selective communication with formation fluid in a formation that is intersected by the wellbore when the linkage assemblies are in the deployed position. The downhole tool can further have actuators coupled to the linkage assemblies for selectively and independently moving the linkage assemblies between the stowed and deployed positions. Conduits and sample tanks are optionally included that are in fluid communication with each of the ports through the conduits.

A method of sampling formation fluid from a formation is also disclosed herein and that includes providing a downhole tool having a body and sample probe assemblies coupled with the body, disposing the downhole tool into a wellbore that intersects the formation and defines a wellbore wall, extending the sample probe assemblies to locations on the wellbore wall that are at the same measured vertical depth in the wellbore, and providing communication between the body and the formation with the sample probe assemblies. The sample probe assemblies can be operated independently of one another. Fluid can be injected into the formation from one of the sample assemblies, and wherein fluid is drawn from the formation into another one of the sample assemblies. In one alternative, fluid is simultaneously communicated through the sample assemblies. Optionally, each of the sample probes has a pad assembly disposed on an end of an articulated linkage arm.

BRIEF DESCRIPTION OF DRAWINGS

Some of the features and benefits of the present invention having been stated, others will become apparent as the description proceeds when taken in conjunction with the accompanying drawings, in which.

Figure 1A:
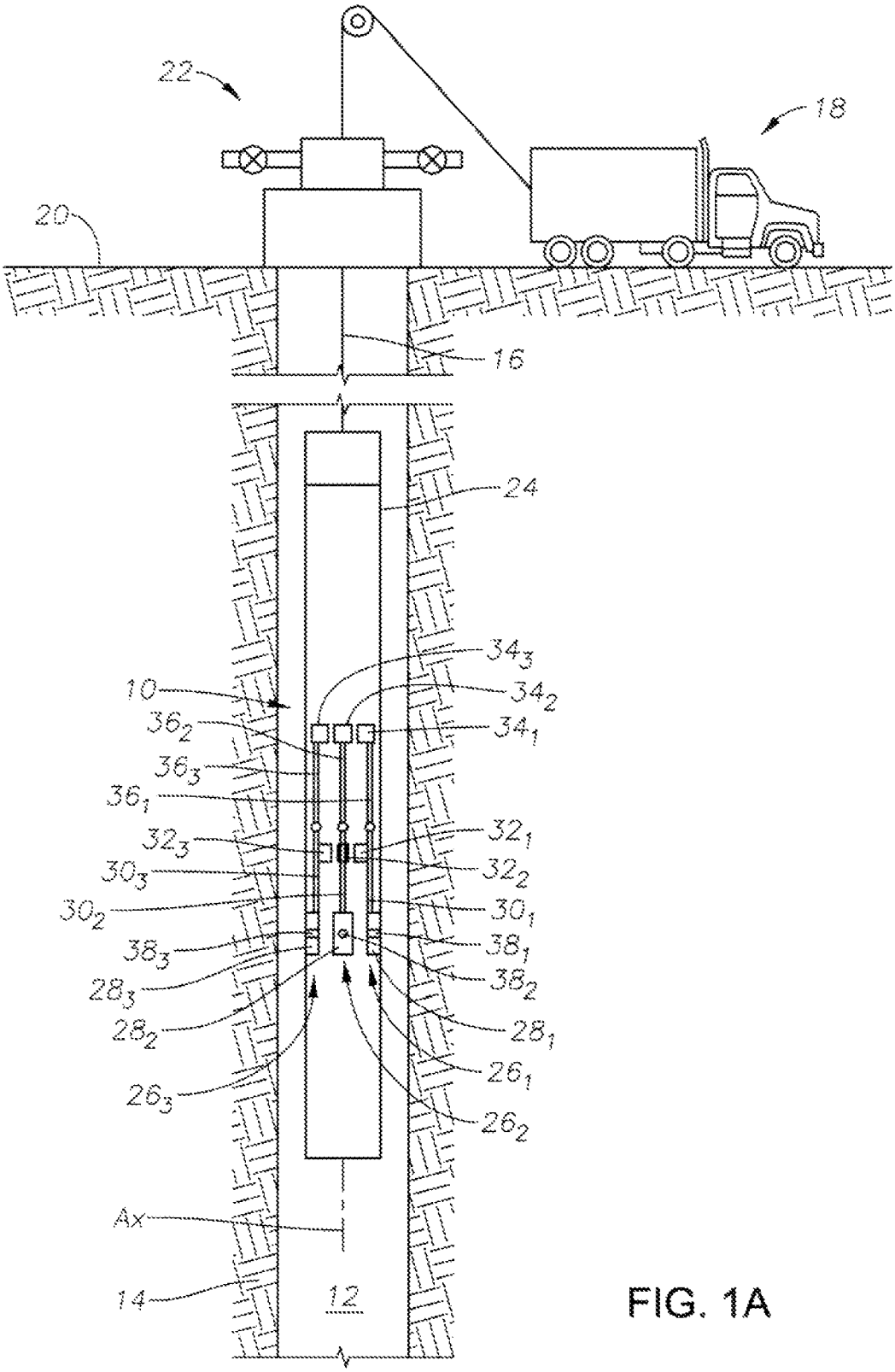
FIG. 1A is partial side section view of a downhole tool in a wellbore with sensor arms in a running configuration.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1A shows one example of a downhole tool 10 disposed in a wellbore. In this example, wellbore 12 intersects a formation 14, and downhole tool 10 is deployed in wellbore 12 on a lower end of wireline 16. Wireline 16 is shown having an upper end spooled onto a surface truck 18 provided at surface 20, and which is proximate an opening at the upper end of wellbore 12. A wellhead assembly 22 is mounted over the opening of wellbore 12, and wireline 16 is shown threaded through wellhead assembly 22. Downhole tool 10 has a body 24, which in one example is a generally cylindrical and elongate member. Provided on body 24 are a series of sample probe assemblies $\mathbf{26}_{1\text{-}3}$. In the example of FIG. 1A, sample probe assemblies $\mathbf{26}_{1\text{-}3}$ are illustrated in a stowed configuration, which may be adjacent body 24 or set within recesses (not shown) formed on the outer surface of body 24. While in the example stowed configuration, sample probe assemblies $\mathbf{26}_{1\text{-}3}$ are generally parallel with an axis $A_X$ of tool 10. Each of sample probe assemblies $\mathbf{26}_{1\text{-}3}$ includes a series of pad assemblies $\mathbf{28}_{1\text{-}3}$ provided on their respective lower ends. It should be pointed out however, that embodiments exist wherein pad assemblies $\mathbf{28}_{1\text{-}3}$ are on an upper end of the sample probe assemblies $\mathbf{26}_{1\text{-}3}$. Further optional embodiments exist wherein some of the sample probe assemblies $\mathbf{26}_{1\text{-}3}$ have pad assemblies $\mathbf{28}_{1\text{-}3}$ on their lower ends, wherein some of the other sample probe assemblies $\mathbf{26}_{1\text{-}3}$ have the pad assemblies $\mathbf{28}_{1\text{-}3}$ on their upper ends. Each of the sample probe assemblies $\mathbf{26}_{1\text{-}3}$ further include elongated linkage arms $\mathbf{30}_{1\text{-}3}$ which couple between the pad assemblies $\mathbf{28}_{1\text{-}3}$ and corresponding actuators $\mathbf{32}_{1\text{-}3}$ shown provided on body 24. As will be described in more detail below, operating actuators $\mathbf{32}_{1\text{-}3}$ in turn moves linkage arms $\mathbf{30}_{1\text{-}3}$ into a designated position to urge the pad assemblies $\mathbf{28}_{1\text{-}3}$ radially away from body 24. Further shown provided with body 24 are sample tanks $\mathbf{34}_{1\text{-}3}$ that are associated with each one of the sample probe assemblies $\mathbf{26}_{1\text{-}3}$. Conduits $\mathbf{36}_{1\text{-}3}$ provide fluid communication respectively between ports $\mathbf{38}_{1\text{-}3}$ provided on pad assemblies $\mathbf{28}_{1\text{-}3}$ and sample tanks $\mathbf{34}_{1\text{-}3}$.

Figure 1B:
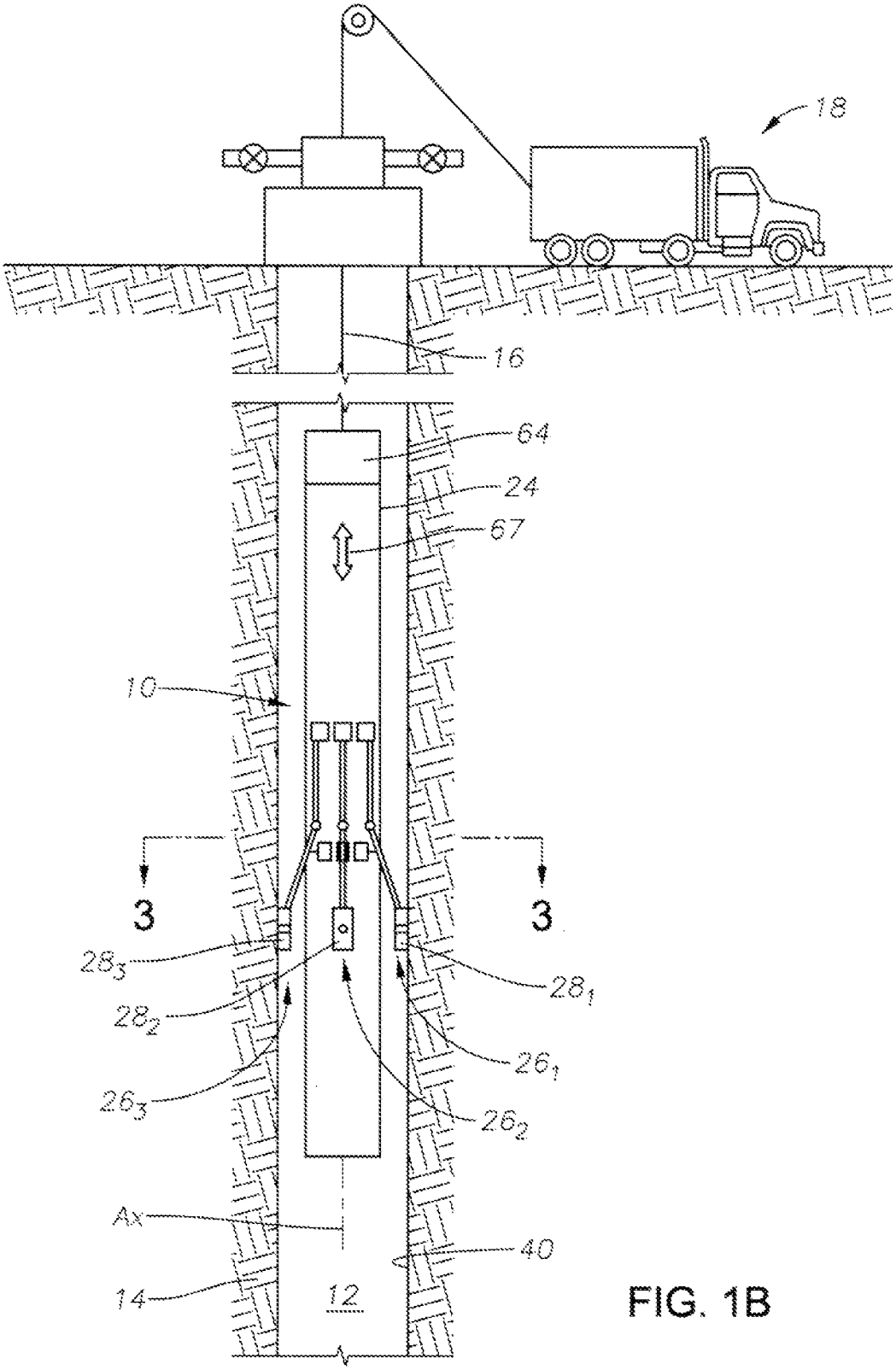
FIG. 1B is partial side section view of a downhole tool of FIG. 1A and with the sensor arms in a deployed configuration.

FIG. 1B shows an example of when the sample probe assemblies $\mathbf{26}_{1\text{-}3}$ are in a deployed configuration and with their respective pad assemblies $\mathbf{28}_{1\text{-}3}$ extended radially outward and into contact with wall 40 that is defined along the inner surface of wellbore 12. Thus in the deployed configuration of FIG. 1B, sample probe assemblies $\mathbf{26}_{1\text{-}3}$ are oblique to axis $A_X$ of tool 10. Also while in the deployed configuration, formation fluid within formation 14 may be drawn into the sample probe assemblies $\mathbf{26}_{1\text{-}3}$ and directed to sample tanks $\mathbf{34}_{1\text{-}3}$ for storage and/or for further analysis. As shown in the example of FIG. 1B, the pad assemblies $\mathbf{28}_{1\text{-}3}$ are at substantially the same "measured depth" in the wellbore 12, that is, the same distance along a path defined by the wellbore 12, from the opening of the wellbore 12 to where on the wall the pad assemblies $\mathbf{28}_{1\text{-}3}$ are disposed.

Figure 2B:
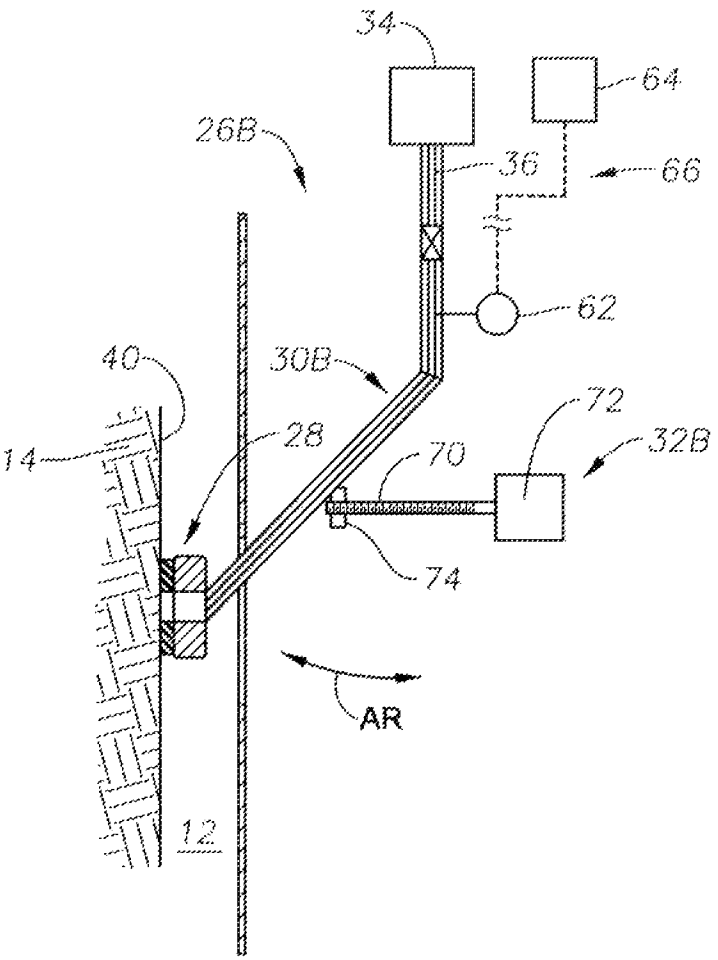
FIGS. 2A-2C are side partial sectional views of example embodiments of the sensor arms of FIG. 1B.
Figure 2A:
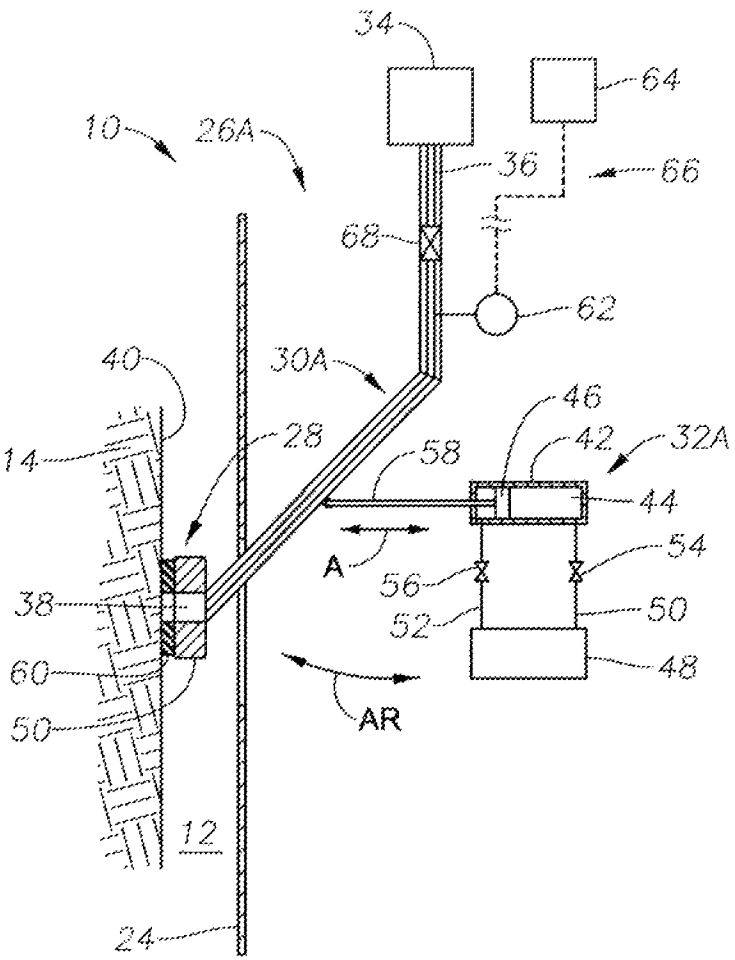

Referring now to FIG. 2A, shown in a partial side sectional view is one embodiment of a sample probe assembly 26A. In the illustrated example a single sample probe assembly 26A is shown as a representative example of the multiplicity of sample probe assemblies 26A that could be included with the tool 10. The sample probe assembly 26A is depicted in the deployed position, with its pad assembly 28A in contact with the wall 40 of wellbore 12. In this example embodiment, actuator 32A is hydraulically powered and includes a housing 42 having an inner cavity that defines a cylinder 44. A piston 46 is reciprocatingly disposed within cylinder 44. A hydraulic source 48 provides pressure communication to and from cylinder 44 via lines 50, 52 shown extending between source and housing 42. Lines 50, 52 are shown on opposite sides of piston 46, so that alternatively changing a direction fluid flow (or pressure) within lines 50, 52 may reciprocate piston 46 within cylinder 44. Valves 54, 56 are optionally provided in lines 50, 52 that may be selectively opened and closed to control flow through lines 50, 52. A rod 58 connects to a side of piston 46, wherein an opposite side of rod 58 couples with linkage arm 30A. Thus by reciprocating piston 46 and rod 58 in the path illustrated by arrow A, pad assembly 28 is urged along an arcuate path, as illustrated by arrow $A_R$. With the pad assembly 28 in contact with wall 40, formation fluid can make its way through port 38, into conduit 36 and onto sample tank 34, whereas indicated above, fluid can be analyzed real time, or stored for later analysis when the tool 10 is brought to surface.

Further in the example of FIG. 2A, pad assembly 28 is shown made up of a pad 59 which connects to a terminal end of arm 30A. A packer 60 is provided on the outer surface of pad 59 and has a surface which is in contact with wall 40. In one example, an outer radial surface of packer 60 contacting wall 40 has a generally rectangular shape and extends along a portion of the circumference of wall 40. Example materials for packer 60 include elastomers that are sufficiently resilient for use, however pliable enough to create a seal around port 38. An optional pressure sensor 62 is shown in fluid communication with conduit 36, thereby putting pressure sensor 62 in pressure communication with formation 12 through conduits 36 provided in the linkage arm 30A. Data sensed by pressure sensor 62 may be communicated to a controller 64 via signal line 66. Signal line 66 can be hard wired, pneumatic, or wireless. Referring back to FIG. 1, controller 64 may be included with tool 10 and wherein communication means 67 is shown passing along body 24. Alternatively, controller 64 can be on surface 20, such as in surface truck 18. Referring back to FIG. 2A, an optional valve 68 is shown provided within conduit 36. An advantage of implementing valve 68 is that when multiple sample assemblies are provided on tool 10, fluid communication through each of the sample probe assemblies can be regulated with the implementation of valve 68. Thus in one example, one or more of the sample probe assemblies may be isolated by closing valve 68, whereas other selective sample probe assemblies may be operated with valve 68 in an open configuration. As such, operational embodiments exist wherein the sample probe assemblies are operated independently from one another.

Shown in partial side sectional view in FIG. 2B is an alternative example of actuator 32B for putting sample probe assembly 26B into a deployed configuration and with the pad assembly 28 and sampling contact with wall 40 of wellbore 12. In this example, the actuator 32B includes a screw member 70 with threads mounted on a shaft, where shaft is rotated by a motor 72. Screw 70 engages a nut 74 mounted on linkage arm 30B, so that selective rotational direction of screw 70 with motor may translate linkage arm 30B in the arcuate path represented by arrow $A_R$. Further, operation of actuator 32B may be accomplished via controller 64.

Figure 2C:
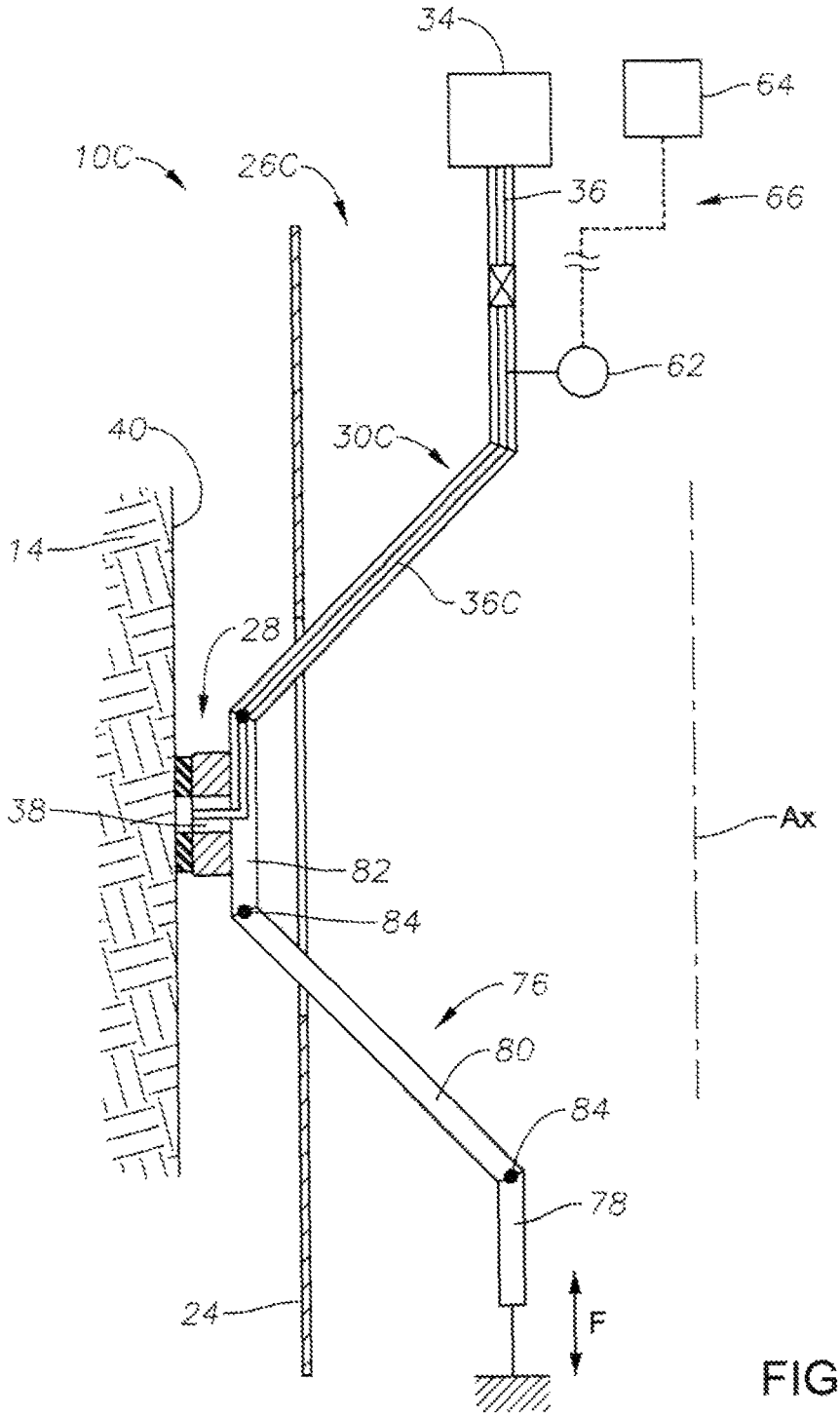

FIG. 2C shows in a partial side sectional view another alternate example of a linkage arm 30C which is shown having a linkage assembly 76. In this example, linkage assembly 76 is made up of a series of linkage arms 78, 80, 82 connected in series to one another via pins 84. Here, pad assembly 28 is in the deployed configuration and against wall 40. In the deployed position, arm 30C and arm 80 are generally oblique to an axis $A_X$ of tool 10C whereas arms 78, 82 are generally parallel with axis $A_X$. A force F applied at an end of arm 78 distal from arm 80 articulates arms 80, 82, 30C about their pinned connected for pad assembly 28 radially outward and into contact. Conversely, applying force F in a direction away from arm 80 and aligned arm 78, 80, 82 to be substantially parallel with axis $A_X$.

Figure 3:
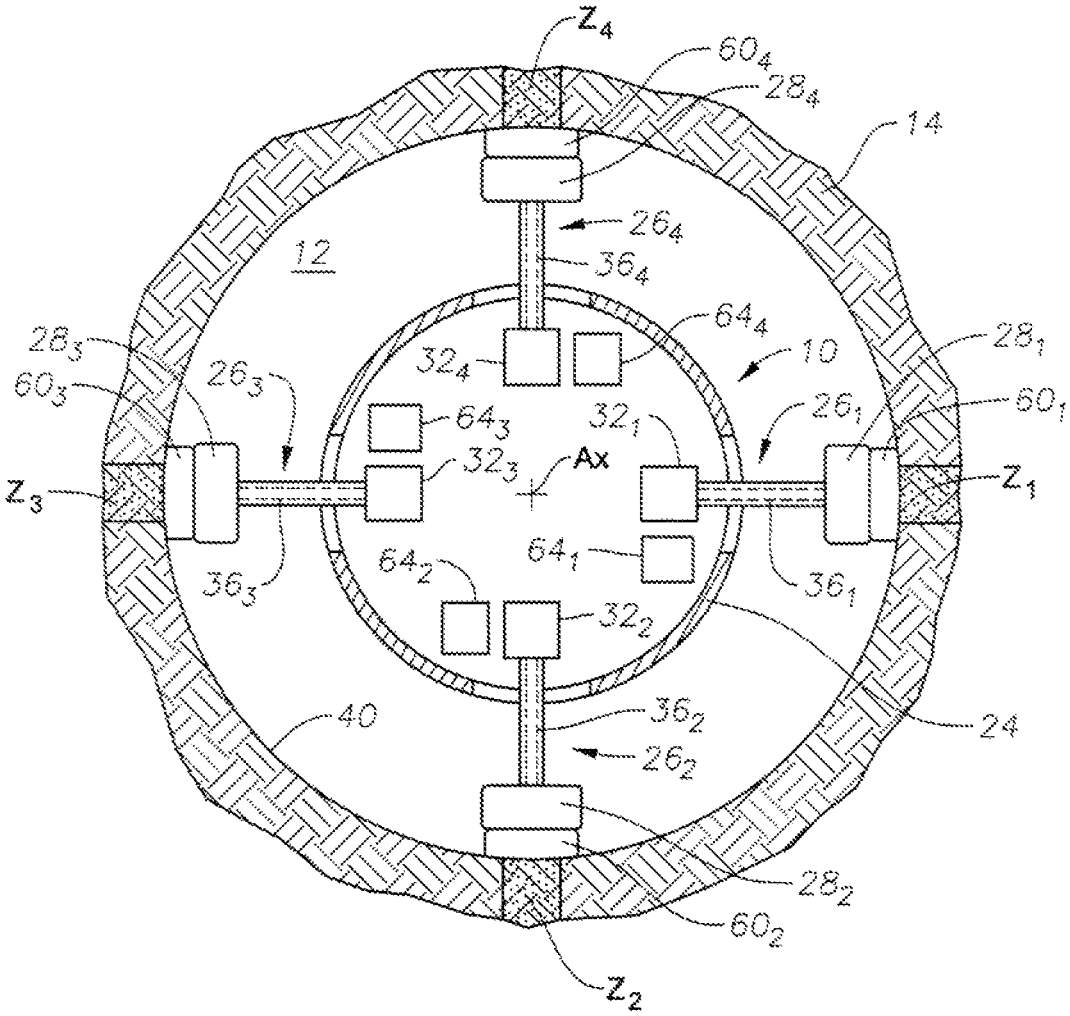
FIG. 3 is an axial view of the downhole tool of FIG. 1B and taken along lines 3-3.

Referring now to FIG. 3, shown is an axial view of an example of tool 10 disposed within wellbore 12, and taken along lines 3-3 of FIG. 1B. In this example a series of four sample probe assemblies $\mathbf{26}_{1\text{-}4}$ are illustrated and in the deployed mode with their respective pad assemblies $\mathbf{28}_{1\text{-}4}$ in sampling contact with wall 40 of wellbore. In this example, zones $Z_{1\text{-}4}$ are represented within formation 14 at angularly spaced apart azimuthal locations along the circumference of wellbore 12. One example of operation, one or more of the sample probe assemblies $\mathbf{26}_{1\text{-}4}$ may in a sampling mode, wherein one or more of other sample probe assemblies $\mathbf{26}_{1\text{-}4}$ may be in an injection mode, so that fluid may be taken from one of these zones $Z_{1\text{-}4}$, while fluid is simultaneously injected into another one of the zones $Z_{1\text{-}4}$. Another alternative, each of sample probe assemblies $\mathbf{26}_{1\text{-}4}$ may be simultaneously drawing fluid from within formation and from zones $Z_{1\text{-}4}$. As indicated above, the implementation of valve 68 within the conduits $\mathbf{36}_{1\text{-}4}$ allows for selective sampling of one or more of the zones $Z_{1\text{-}4}$ at the same time. Furthermore, another advantage is realized by positioning the sample probe assemblies $\mathbf{26}_{1\text{-}4}$ within the tool body 24 so that when in the deployed configuration, the pad assemblies $\mathbf{28}_{1\text{-}4}$ are at substantially the same measured depth within wellbore 12. Moreover, the mechanical nature of the linkage assemblies described herein allows for the simultaneous placement of pad assemblies $\mathbf{28}_{1\text{-}4}$ at the same measured depth to take place in a vertical portion of the wellbore 12, a deviated portion of the wellbore 12, or a horizontal portion of the wellbore 12. Other known prior art devices are unable to achieve this functionality within the aforementioned different wellbore orientations. Further illustrated in the example of FIG. 3 are dedicated controllers $\mathbf{64}_1$-$\mathbf{64}_4$ for use with each of the sample probe assemblies $\mathbf{26}_1$-$\mathbf{26}_4$.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In an example embodiment, sample probe assemblies can be provided that are disposed axially from one another, so that sampling can take place at different depths in the wellbore with the tool 10. This and other similar modifications will readily suggest themselves to those skilled in the art, and are intended to be encompassed within the spirit of the present invention disclosed herein and the scope of the appended claims.

What is claimed is:

1. A downhole tool for sampling formation fluid in a wellbore comprising:

a body;

sample probe assemblies that comprise, linkage assemblies that each comprise, an arm having an end hingedly coupled with the body, and a hydraulically actuated piston coupled with the arm, pad assemblies that selectively project radially outward from the body on the ends of the linkage assemblies and into sampling engagement with a wall of the wellbore at substantially the same measured depth in the wellbore, actuators in the body coupled with each one of the linkage assemblies and that are each selectively operated independently from the other actuators, the actuators each comprising a hydraulic source in selective pressure communication with an end of the piston, so that when the hydraulic source provides pressurized fluid to an end of the piston, the arm is selectively moved radially with respect to the body to move the pad assembly with respect to the wellbore wall; and a means for obtaining a sample of formation fluid in the wellbore with a first one of the sample probe assemblies at a first depth in the wellbore, while simultaneously injecting fluid into the formation with a second one of the sample probe assemblies at the first depth in the wellbore.

2. The tool of claim 1, further comprising sample tanks, wherein each one of the sample tanks are in fluid communication with a one of the sampling pads, so that formation fluid obtained by each of the sampling pads is stored in a one of the sample tanks.

3. The tool of claim 2, further comprising a conduit between each one of the pad assemblies and each one of the sample tanks, so that each of the sample tanks contains fluid obtained from a single one of the sample probe assemblies.

4. The tool of claim 1, wherein each of the pad assemblies comprises a packer having an outer radial surface that contacts the wellbore wall, and a port in a mid-portion of the outer radial surface that is in fluid communication with the formation fluid in a formation intersected by the wellbore.

5. The tool of claim 1, further comprising pressure sensors in communication with each of the sample probe assemblies, so that pressure of a formation intersected by the wellbore can be sensed along discrete locations along the circumference of the wellbore and at the same depth in the wellbore.

6. The tool of claim 1, wherein the linkage assemblies each comprise an arm, and wherein the actuator comprises a screw having an end coupled to a motor, and having a portion that threadingly engages the arm, so that when the screw is rotated by the motor, the arm is moved radially with respect to the body.

7. The tool of claim 1, wherein the linkage assemblies each comprise a series of arms pivotingly linked in series together, and wherein a one of the pad assemblies is mounted on a middle one of the arms, so that when a force is applied to an end of the series of arms, the one of the pad assemblies is urged radially with respect to the body.

8. The tool of claim 1, further comprising a controller in communication with the actuators, so that each of the actuators is operated independently with respect to the other actuators.

9. The tool of claim 1, wherein the linkage assemblies travel along an arcuate path between a stowed position adjacent the body and an engaged position in contact with the wellbore wall.

* * * * *